United States Patent [19]

Helling et al.

[11] Patent Number: 4,865,960

[45] Date of Patent: Sep. 12, 1989

[54] POLYMERIC MAGNETA COUPLER AND A COLOR PHOTOGRAPHIC RECORDING MATERIAL CONTAINING THIS POLYMERIC MAGENTA COUPLER

[76] Inventors: Günter Helling; Erich Wolff, both of AGFA-Gevaert Aktiengesellschaft, D-5090 Leverkusen, Fed. Rep. of Germany

[21] Appl. No.: 21,782

[22] Filed: Mar. 4, 1987

[30] Foreign Application Priority Data

Mar. 15, 1986 [DE] Fed. Rep. of Germany ..... 3608744

[51] Int. Cl.[4] ..... G03C 7/38

[52] U.S. Cl. ..... 430/548; 430/558; 430/630

[58] Field of Search ..... 430/558, 548, 381, 630

[56] References Cited

U.S. PATENT DOCUMENTS

| | | | |
|---|---|---|---|
| 4,511,647 | 4/1985 | Hirano et al. | 430/381 |
| 4,576,910 | 3/1986 | Hirano et al. | 430/548 |
| 4,585,732 | 4/1986 | Kawagishi et al. | 430/558 |
| 4,612,278 | 9/1986 | Lau et al. | 430/381 |
| 4,663,272 | 5/1987 | Nakamura | 430/548 |
| 4,756,998 | 7/1988 | Helling et al. | 430/548 |

FOREIGN PATENT DOCUMENTS

| | | | |
|---|---|---|---|
| 2019848 | 1/1987 | Japan | 430/548 |

*Primary Examiner*—Paul R. Michl

*Assistant Examiner*—Lee C. Wright

[57] ABSTRACT

Magenta images of increased color density $D_{max}$ can be obtained by using polymeric couplers containing polymerized units of a polymerizable pyrazoloazole coupler of formula I and polymerized units of a polymerizable monomer S which contains at least one acid group and is unsoluble in water at pH $\leqq 6$ and soluble in water at pH $\geqq 10$.

I

In formula I $R^1$ denotes H, alkyl, aralkyl or aryl,

X denotes H or a group which is releasable by coupling, and $Z_a$, and $Z_b$ and $Z_c$ denote a substituted or unsubstituted methine group, =N— or —NH—, and either the linkage in $Z_a$—$Z_b$ or the linkage in $Z_b$—$Z_c$ is a double bond and the other linkage is a single bond, and at least $R^1$ or X or a substituent on a methine group denoted by $Z_a$, $Z_b$ or $Z_c$ contains an ethylenically unsaturated, polymerizable group.

3 Claims, No Drawings

POLYMERIC MAGNETA COUPLER AND A COLOR PHOTOGRAPHIC RECORDING MATERIAL CONTAINING THIS POLYMERIC MAGENTA COUPLER

This invention relates to a polymeric magenta coupler and to a coupler photographic recording material containing this polymeric magenta coupler. The polymeric magenta coupler is obtained by the polymerisation of ethylenically unsaturated monomers and contains pyrazolo-azole groups and acid groups.

It is known to produce coloured photographic images by chromogenic development, i.e. by developing imagewise exposed silver halide emulsion layers by means of suitable colour producing developer substances, so-called colour developers, in the presence of suitable colour couplers. In this process, the oxidation product of developer substances formed in correspondence with the silver image reacts with the colour coupler to form a dye image. The colour developers used are generally aromatic compounds containing primary amino groups, in particular those of the p-phenylenediamine series.

It is known to use the colour couplers in the form of polymer dispersions in which the functional group of a colour coupler is attached once or several times to a polymer structure and thereby rendered diffusion resistant. Such a polymer therefore has recurrent structural units containing the colour coupler.

Colour couplers which are incorporated in the layers of photographic recording materials in the form of such polymer dispersions are generally sufficiently fast to diffusion and do not significantly impair the mechanical properties of the layers even if the binder content is low. It is particularly important that they should not crystallize in storage and should have good stability to light, heat and moisture and the dyes produced from them should also be stable and have the desired spectral properties and should be fast to diffusion in the process of development and be deposited as a very fine grain. When colour couplers in the form of such polymer dispersions having molecular weights greater than 5000 are incorporated in photographic recording materials, they generally have sufficient stability to colloids and fulfil some of the requirements quite satisfactorily. High molecular weight colour couplers of this kind have been described, for example, in DE-C-1 297 417, DE-A-2 407 569, DE-A-3 148 125, DE-A-3 217 200, DE-A-3 320 079, DE-A-3 324 932, DE-A-3 331 743, DE-A-3 340 376, DE-A-3 461 455, EP-A-27 284 and US-A-4 080 211.

The high molecular weight colour couplers are generally prepared by the polymerisation of ethylenically unsaturated, so-called monomeric colour couplers.

The known polymeric magenta couplers have, however, the following disadvantages:

The magenta dyes obtained from the polymeric pyrazolone couplers do not have ideal absorption properties. Particularly disturbing is the yellow side density which necessitates the use of masking couplers.

Polymeric pyrazolo-azole couplers such as the compounds M-23 to M-27 described in DE-A-3 516 996 or Compound XV of EP-A-0 133 262 have a completely unsatisfactory dye yield and are therefore unusable.

It is an object of the present invention to provide improved polymeric magenta couplers for colour photographic recording materials.

New polymeric magenta couplers have now been found. These new couplers are copolymers containing recurrent units of a polymerised monomer K which carries pyrazoloazole groups capable of coupling and otnher recurrent units of at least one other polymerised monomer, characterised in that at least one of the other monomers contains at least one acid group and is insoluble in water at pH $\leqq 6$ and soluble in water at pH $\geqq 10$. These other monomers will hereinafter be referred to as monomers S.

In a preferred embodiment, the acid group is a carboxylic acid, sulphonamide, sulphonimide, CH-acidic or phenolic group.

Examples of monomers S are shown below:

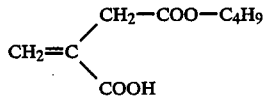
S-1

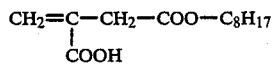
S-2

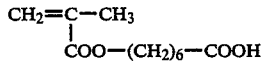
S-3

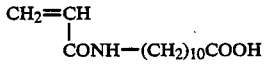
S-4

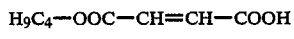
S-5

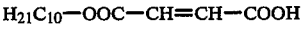
S-6

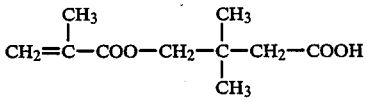
S-7

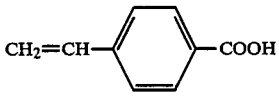
S-8

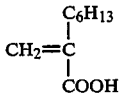
S-9

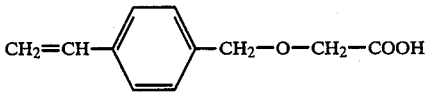
S-10

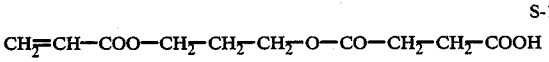
S-11

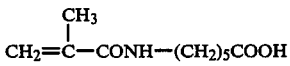
S-12

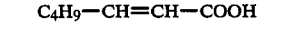
S-13

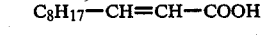
S-14

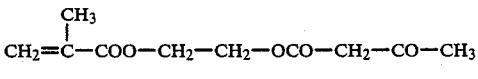
S-15

S-16

-continued

S-17

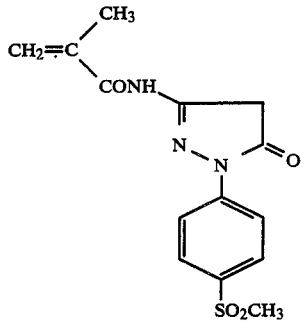

S-19

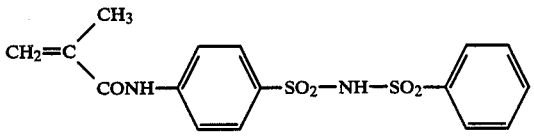

S-20

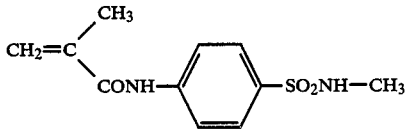

S-21

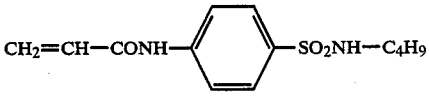

S-22

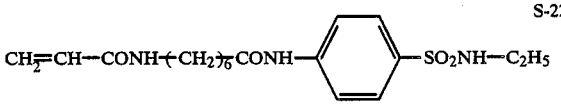

S-23

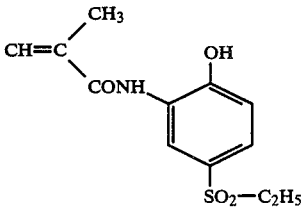

S-24

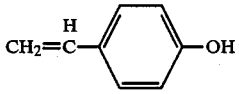

S-25

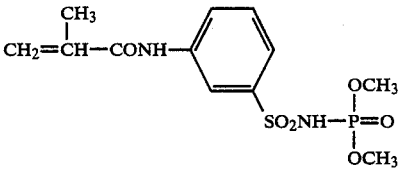

Monomer K containing coupler corresponds to the general formula I

I

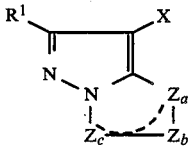

wherein $R^1$ denotes H, alkyl, aralkyl or aryl,

X denotes H or a group which can be released by coupling, and $Z_a$, $Z_b$ and $Z_c$ denote an optionally substituted methine group, =N— or —NH—, and either the linkage $Z_a$—$Z_b$ or the linkage $Z_b$—$Z_c$ is a double bond while the other bond is a single bond;

and at least $R^1$ or X or a substituent on a methine group denoted by $Z_a$, $Z_b$ or $Z_c$ contains an ethylenically unsaturated polymerisable group corresponding to the formula

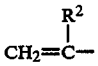

wherein $R^2$ denotes H, halogen, in particular chlorine, or alkyl, preferably with 1 to 4 carbon atoms.

An alkyl, aralkyl or aryl group denoted by $R^1$ may be substituted, e.g. with halogen, alkoxy, aroxy, acylamino or (e.g. in the case of aryl) with alkyl and may contain the above-mentioned ethylenically unsaturted, polymerisable groups, optionally on such substituents.

A substituted methine group denoted by $Z_a$, $Z_b$ or $Z_c$ corresponds to the formula

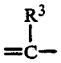

wherein $R^3$ denotes alkyl with up to 18 carbon atoms, aryl, aralkyl, a heterocyclic aromatic group, alkoxy, a carbonamide group, OH or COOH, and the above-mentioned alkyl, aralkyl or aryl groups in particular may be further substituted and may contain the above-mentioned ethylenically unsaturated, polymerisable group. optionally by way of such substituents.

The releasable group denoted by X may be, for example, a halogen atom, e.g. Cl, or an organic group, which is generally attached to the coupling position of the coupler molecule through an oxygen, sulphur or nitrogen atom. If the releasable group is a cyclic group, its attachment to the coupling position of the coupler molecule may be either direct through an atom which forms part of a ring, e.g. a nitrogen atom, or indirect by way of an interposed connecting member. Many such releasable groups are known, e.g. as the fugitive groups of 2-equivalent magenta couplers.

Examples of releasable groups attached via oxygen correspond to the formula $$-O-R^4,$$

wherein $R^4$ denotes a cyclic or acyclic organic group, e.g. an alkyl or aryl group, a heterocyclic group or acyl which may be derived, for example, from an organic carboxylic or sulphonic acid. In particularly preferred releasable groups of this kind, $R^4$ stands for a substituted or unsubstituted phenyl group.

Examples of releasable groups attached through nitrogen are described in the following German Offenlegungsschriften (DE-A-): 2 536 191, 2 703 589, 2 813 522 and 3 339 201.

These groups are in many cases 5-membered heterocyclic rings which are attached to the coupling position of the magenta coupler through a ring nitrogen atom.

The heterocyclic rings in many cases contain activating groups such as carbonyl or sulphonyl groups or double bonds in positions adjacent to the nitrogen atom through which the coupler molecule is attached.

If the releasable group is attached to the coupling position of the coupler through a sulphur atom then it may consist of the residue of a diffusible mercapto compound which is capable of inhibiting the development of silver halide. Inhibitor groups of this kind have frequently been described as releasable groups attached to the coupling position of couplers, including magenta couplers, e.g. in US-A-3 227 554.

The releasable group denoted by X may also contain the above-mentioned ethylenically unsaturated, polymerisable group, for example as described in Research Disclosure 25724 (September 1985).

Examples of monomers K containing couplers correspond to the following formulae II to VI:

II

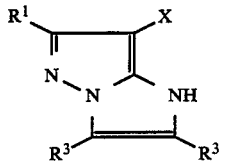

III

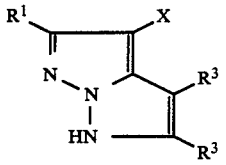

IV

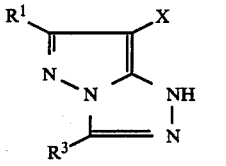

V

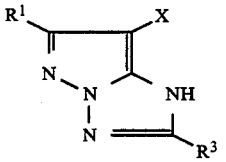

VI

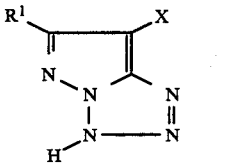

wherein X, $R^1$ and $R^2$ have the meanings already indicated but two groups denoted by $R^3$ present in the same formula (II, III) need not necessarily be identical and at least one of the groups $R^1$, $R^3$ and X in each of the formulae II to VI contains an ethylenically unsaturated, polymerisable group. Monomers corresponding to formula IV are preferred.

The ethylenically unsaturated group may be attached to one of the two heterocyclic rings in one of the formulae II to VI either directly or indirectly through a connecting member L. Such a connecting member L may have a composite structure, for example as indicated by the formula:

$$-(L^0)_k-(L^1)_l-(L^2)_m-(L^3)_n-(L^4)_o-(L^5)_p-(L^6)_q-(L^7)_r-$$

wherein $L^0$ denotes the part of the connecting member closest to the heterocyclic ring while $L^7$ denotes the part closest to the ethylenically unsaturated group, and the symbols have the following meanings (identical or different):

$L^0$, $L^2$, $L^4$, $L^6$: —O—, —NH—, —NHCO—, —CONH—, —$NHSO_2$—, —$SO_2NH$—, —COO—, —O—CO—, —NH—CO—NH—, —O—CO—NH—, —NH—COO—;

$L^1$, $L^3$, $L^5$: alkylene, aralkylene, arylene;

$L^7$: arylene;

k, l, m, n, o, p, q, r: 0 or 1 under the condition that $l-m+n-o+p-q=0$.

An alkylene group denoted by $L^1$, $L^3$ or $L^5$ may be straight chained or branched and may have up to 20 carbon atoms.

An aralkylene group denoted by $L^1$, $L^3$ or $L^5$ may consist, for example, of one of the following groups:

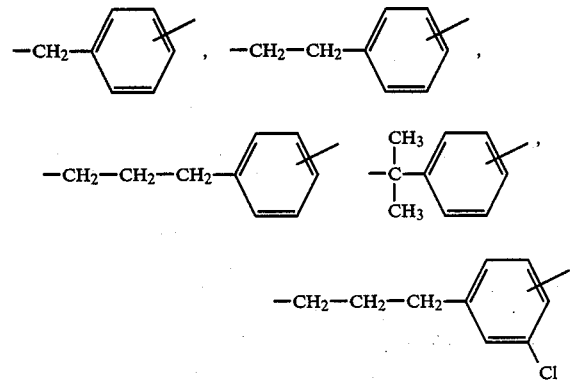

An arylene group denoted by $L^1$, $L^3$, $L^5$ or $L^7$ is preferably a phenylene group which may be substituted, e.g. with alkyl, alkoxy, halogen or acylamino.

Examples of suitable monomers K containing coupler groups are shown below:

K-1

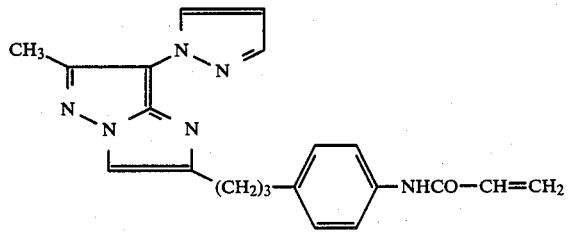

-continued
K-2
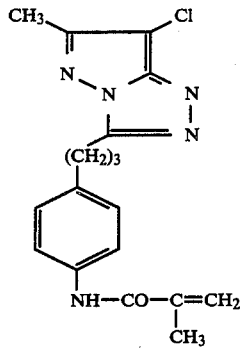
K-3
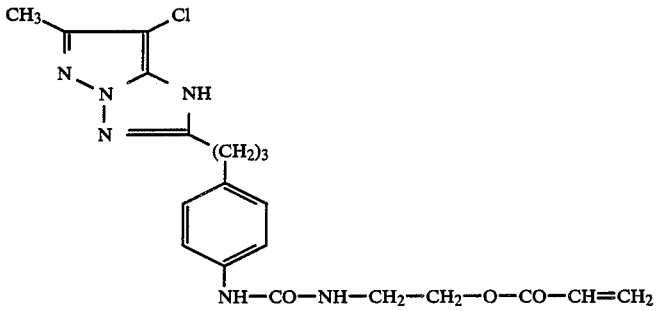
K-4
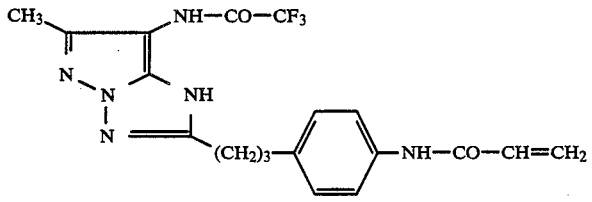
K-5
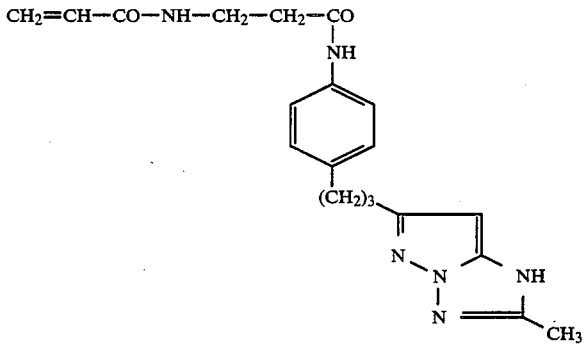
K-6
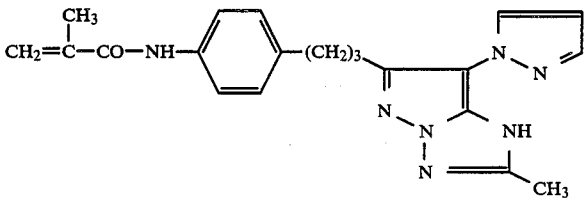

-continued

K-7

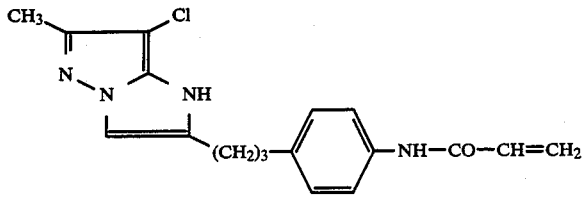

K-8

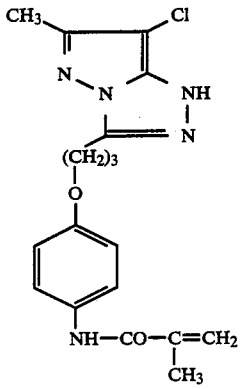

K-9

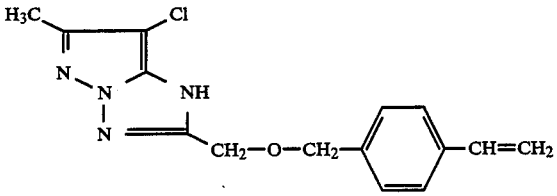

K-10

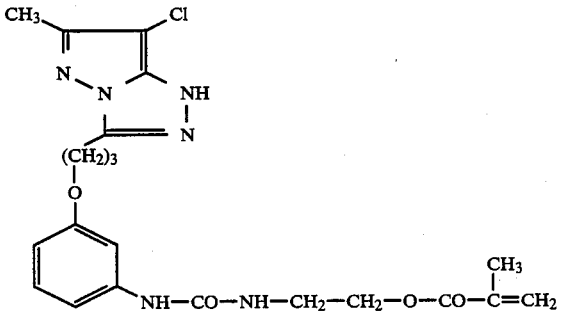

K-11

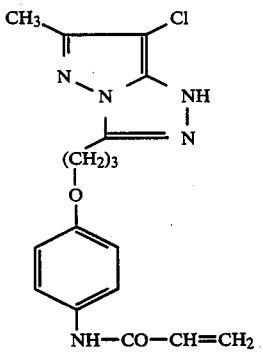

The proportion of monomers K containing couplers in the copolymer is generally 20 to 70% by weight, preferably 25 to 50% by weight and the proportion of monomer S is generally 5 to 50% by weight, preferably 10 to 30% by weight.

In addition to containing the recurrent units of coupler-containing monomer K and the recurrent units of monomer S, the copolymers according to the invention may contain recurrent units of at least one other copolymerised monomer C. Examples of such monomers C include esters and amides of acrylic acid and derivatives thereof, e.g. of acrylic acid, α-chloroacrylic acid, methacrylic acid (for example, acrylamide, methylmethacrylate, ethylacrylate, ethylmethacrylate, n-propylacrylate, n-butylacrylate, 2-ethylhexylacrylate, n-hexylacrylate, octylmethacrylate, laurylmethacrylate and methylene-bis-acrylamide), vinyl esters, (for example vinyl acetate, vinyl propionate and vinyl laurate), acrylonitrile, methacrylonitrile, aromatic vinyl compounds, (for example styrene, vinyltoluene, divinylbenzene, vinylacetophenone or styrene sulphonic acid), itaconic acid, citraconic acid, crotonic acid, vinylidene chloride, vinyl alkyl ethers (for example, vinyl ethyl ether), esters of maleic acid, N-vinyl-2-pyrrolidone, N-vinylpyridine, 2-vinylpyridine and 4-vinylpyridine. The proportion of monomer C in the polymeric colour coupler may amount to 0–75% by weight and is preferably 20–65% by weight.

It is particularly preferred to use an ester of acrylic or methacrylic acid and/or an aromatic vinyl compound as monomer C. Two or more of the monomers C described above may be used. For example, a combination of n-butylacrylate and divinylbenzene, of styrene and methylmethacrylate or of methylacrylate and butylmethacrylate may be used. The ethylenically unsaturated monomer C may be specially chosen to have an advantageous effect on the physical properties and/or chemical properties of the copolymer to be produced, for example its solubility, compatibility with a binder such as gelatine or other photographic additives such as colour producing compounds, ultraviolet absorbent agents, antioxidants and the like and on the flexibility of the layers and groups of layers of the colour photographic recording materials. Although the monomers C generally do not contain any groups with a photographically active effect, the compounds used as monomers C may contain a photographically active group in addition to the ethylenically unsaturated, polymerisable group, e.g. they may contain a group capable of coupling but this would be different from the coupler group represented by formula I. Such groups capable of coupling may have the properties, for example, of white couplers or of masking couplers or they may release a photographically active group in the coupling reaction, e.g. an inhibitor or development accelerator.

The molecular weights of the polymers according to the invention are preferably greater than 5000, in particular greater than 20,000. The upper limit is not critical and may attain values above 10 million, especially if bifunctional or polyfunctional monomers are used as additional monomers C.

The polymeric magenta couplers according to the invention are generally added to the photographic recording materials in the form of polymer dispersions, e.g. as a polymer latex.

Polymerisation of the monomer mixture (monomer K, monomer S and optionally monomer C) may be carried out by one of the usual processes of polymerisation, e.g. emulsion polymerisation or polymerisation in an organic solvent.

Polymerisation of the ethylenically unsaturated monomers is generally initiated by free radicals which are formed by thermal decomposition of a chemical initiator, by the action of a reducing agent on an oxidizing compound (redox initiator) or by a physical effect such as irradiation with ultraviolet rays or other high energy rays or high frequency waves, etc.

Examples of chemical initiators include persulphates (for example, ammonium persulphate, potassium persulphate, etc.), peroxides (for example, hydrogen peroxide, benzoyl peroxide or tertiary butyl peroctoate) and azonitrile compounds (for example, 4,4'-azo-bis-4-cyanovaleric acid or azo-bis-butyronitrile).

Examples of conventional redox initiators include hydrogen peroxide-iron-(II) salt, potassium persulphate, sodium metabisulphate and cerium-IV-salt-alcohol.

Examples of initiators and their functions are described by F. A. Bovey in Emulsion Polymerisation, Interscience Publishers Inc., New York, 1955, pages 59 to 93.

Compounds with a surface-active action may be used as emulsifiers for emulsion polymerisation. Preferred examples of such compounds include soaps, sulphonates, sulphates, cationic compounds, amphoteric compounds and high molecular weight protective colloids. Special examples of emulsifiers and their functions are described in Belgische Chemie Industrie (Belgian Chemical Industry), Volume 28, pages 16 to 20, 1963.

If an organic solvent is used for the preparation of the polymer or for its dispersion in an aqueous gelatine solution, the solvent may be removed from the casting solution before the solution is cast.

The solvents used may be of the kind, for example, which are to some extent soluble in water so that they can easily be removed in the form of gelatine shreds when washed with water or they may be of the kind which can be removed by spray drying or vacuum or vapour rinsing.

Examples of such solvents include exters (for example, ethyl acetate), ethers, ketones, halogenated hydrocarbons (for example, methylene chloride or trichloroethylene), alcohols (for example, methanol, ethanol or butanol) and combinations thereof.

A small quantity (preferably not more than 50% by weight, based on the polymeric couplers according to the invention) of a permanent solvent may be added, in particular a high boiling, water-immiscible organic solvent such as dibutylphthalate and/or tricresylphosphate, for the purpose of improving tne dispersion stability or the flexibility of the cast emulsion. The concentration of permanent solvent should be sufficient to plasticize the polymer while it is kept in a state of solid particles. At the same time, however, the concentration of permanent solvent should be as low as possible in order to keep the layer as thin as possible and limit its weight.

Some representative examples of syntheses of the polymeric magenta couplers according to the invention are described below.

POLYMERIC COUPLER 1

Copolymer coupler obtained from pyrazolotriazole monomer K-2, butylacrylate and Monomer S-4

0.7 g of Oleylmethyltauride were dissolved in 136 ml of water in an atmosphere of nitrogen and heated to 80° C. 0.57 g of an initiator solution of 2 g of potassium peroxidisulphate in 100 ml of water and a suspension of 4.5 g of coupler K-2, 7.5 g of butyl acrylate and 3 g of monomer S-4 in 68 ml of methanol were than added simultaneously to this solution. A further 6.8 ml of initiator solution was added dropwise within 1 hour and the reaction mixture was then stirred for 2 hours at 80° C. The methanol was then distilled off and the aqueous residue was adjusted to a solids content of 10% by weight. A finely divided latex with a residue of less than 2% was obtained.

POLYMER COUPLER 2

Copolymer coupler of pyrazolotriazole monomer K-2, ethyl acrylate and monomer S-4

0.7 g of oleyl methyl tauride were dissolved in 136 ml of water in an atmosphere of nitrogen and heated to 80° C. 0.57 g of an initiator solution of 2 g of potassium peroxidisulphate in 100 ml of water and a suspension of 4.5 g of coupler K-2, 6.0 g of ethyl acrylate and 4.5 g of monomer S-4 in 68 ml of methanol were then both added at the same time to this solution. A further 6.8 ml of initiator solution were then added dropwise in 1 hour and the reaction mixture was stirred for 2 hours at 80° C. The methanol was then distilled off and the aqueous residue was adjusted to a solids content of 10% by weight. A finely divided latex with a residue of less than 2% was obtained.

POLYMER COUPLERS 3–21

The polymer couplers described in Table 1 below were prepared from the above-described coupler-containing monomers K and monomers S by the same method as that described for the copolymers in the previous examples.

The following abbreviations are used for the comonomers C:

BA: butylacrylate
EA: ethylacrylate
EHA: ethylhexylacrylate
MA: methylacrylate
BM: butylmethacrylate
PPA: i-propylacrylamide
AS: acrylic acid.

Table 1 also shows the comparison couplers A and B which do not contain recurrent units of an acid monomer, and comparison couplers C and D which contain recurrent units of a water-soluble acid monomer.

TABLE 1

| Polymer coupler | Monomer K | % by wt. | Monomer S | % by wt. | Monomer C | % by wt. |
|---|---|---|---|---|---|---|
| 3 | K-2 | 30 | S-9 | 15 | BA | 55 |
| 4 | K-2 | 35 | S-12 | 20 | BA | 45 |
| 5 | K-2 | 30 | S-17 | 10 | EA | 60 |
| 6 | K-2 | 35 | S-23 | 20 | EHA | 45 |
| 7 | K-3 | 30 | S-4 | 30 | EA | 40 |
| 8 | K-3 | 40 | S-9 | 25 | MA | 35 |
| 9 | K-3 | 30 | S-11 | 20 | BA/PAA (1:1) | 50 |
| 10 | K-3 | 35 | S-16 | 25 | BA | 40 |
| 11 | K-4 | 30 | S-12 | 20 | BA | 50 |
| 12 | K-4 | 30 | S-11 | 15 | BA | 55 |
| 13 | K-7 | 30 | S-23 | 20 | EA | 50 |
| 14 | K-7 | 30 | S-20 | 15 | BA | 55 |
| 15 | K-7 | 30 | S-3 | 25 | BA | 45 |
| 16 | K-2 | 30 | S-24 | 30 | MA | 40 |
| 17 | K-2 | 40 | S-3 | 20 | BA | 40 |
| 18 | K-2 | 40 | S-1 | 15 | EA | 45 |
| 19 | K-3 | 35 | S-25 | 20 | EA | 45 |
| 20 | K-3 | 30 | S-20 | 20 | BA | 50 |
| 21 | K-2 | 30 | S-6 | 15 | EA | 55 |
| 22 | K-8 | 30 | S-4 | 20 | BA | 50 |
| 23 | K-8 | 35 | S-1 | 16 | EA | 49 |
| 24 | K-8 | 30 | S-5 | 15 | BA | 55 |
| 25 | K-9 | 30 | S-3 | 20 | BA | 50 |
| 26 | K-10 | 40 | S-2 | 15 | BA | 45 |
| 27 | K-10 | 35 | S-4 | 25 | EA | 40 |
| 28 | K-10 | 45 | S-5 | 10 | BA | 45 |
| 29 | k-11 | 30 | S-12 | 20 | EA/BA (1:1) | 50 |
| 30 | K-11 | 50 | S-4 | 10 | BA | 40 |
| 31 | K-11 | 30 | S-11 | 16 | EA | 54 |
| 32 | J-11 | 40 | S-4 | 20 | EA | 40 |
| A | K-2 | 30 | — | — | BA | 70 |
| B | K-2 | 30 | — | — | EA | 70 |
| C | K-8 | 30 | — | — | BA/AS (9:1) | 70 |
| D | K-11 | 30 | — | — | BA/AS (8:1) | 70 |

= acrylic acid

The colour photographic recording material according to the invention contains at least one light-sensitive silver halide emulsion layer and preferably a sequence of several such light-sensitive silver halide emulsion layers optionally with light-insensitive layers of binder arranged between them, and at least one of the light-sensitive silver halide emulsion layers present has a polymeric magenta coupler according to the present invention associated therewith.

The halides contained in the light-sensitive silver halide emulsions used in the light-sensitive layers may be chloride, bromide, iodide or mixtures thereof. At least one layer, for example, may have a halide content composed of 0 to 12 mol-% of iodide, 0 to 50 mol-% of chloride and 50 to 100 mol-% of bromide. In certain embodiments, the halides are predominantly compact crystals which may be e.g. cuboid or octahedral or they may have transitional forms. They may be characterised in that they mainly have a thickness greater than 0.2 μm. The average ratio of their diameter to thickness is preferably less than 8:1, the diameter of a grain being defined as the diameter of a circle having the same surface area as the projected surface of the grain. In other embodiments, all or some of the emulsions may contain mainly tabular silver halide crystals in which the ratio of diameter to thickness is greater than 8:1. The emulsions may be heterodisperse or monodisperse, preferably with a mean grain size of 0.3 μm to 1.2 μm. The silver halide grains may also have a layered grain structure.

The emulsions may be chemically or spectrally sensitized in the usual manner and they may be stabilized with suitable additives. Suitable chemical sensitizers, spectral sensitizing dyes and stabilizers have been described, for example, in Research Disclosure 17643; see in particular Chapters III, IV and VI.

The colour photographic recording material according to the invention preferably contains at least one silver halide emulsion layer for each of the three spectral regions, red, green and blue. The light-sensitive layers are spectrally sensitized with suitable sensitizing dyes for this purpose in known manner. Blue-sensitive silver halide emulsion layers need not necessarily contain a spectral sensitizer since the intrinsic sensitivity of the silver halide is in many cases sufficient for recording blue light.

Each of the above-mentioned light-sensitive layers may consist of a single layer or it may be composed in known manner to two or more silver halide emulsion partial layers, e.g. as in the so-called double layered arrangement (DE-C-1 121 470). Red-sensitive silver halide emulsion layers are normally arranged closer to the layer support than green-sensitive silver halide emulsion layers which in turn are closer to the support than the blue-sensitive layers, and a light-insensitive yellow filter layer is generally placed between the green-sensitive layers and the blue-sensitive layers. Other arrangements, however, could equally well be used. A light-insensitive interlayer is generally arranged between layers which differ in their spectral sensitivity. Such an interlayer may contain agents for preventing accidental diffusion of developer oxidation products. When a material contains several silver halide emulsion layers of the same spectral sensitivity, these may be arranged directly adjacent to one another or they may be separated by a light-sensitive layer having a different spectral sensitivity (DE-A-1 958 709, DE-A-2 530 645, DE-A-2 622 922).

Colour photographic recording materials according to the invention normally contain colour couplers for producing the various partial colour images in cyan, magenta and yellow in spatial and spectral association with the silver halide emulsion layers of the different spectral sensitivities. The polymeric coupler according to the present invention is generally associated with green-sensitive silver halide emulsion layer.

By "spatial association" is meant that the colour coupler is so related in space to the silver halide emulsion layer that the two layers are capable of interacting to give rise to an imagewise correspondence between the silver image formed on development and the colour image produced from the colour coupler. This is generally achieved by accommodating the colour coupler in the silver halide emulsion layer itself or in an adjacent layer of binder which need not be light-sensitive.

By "spectral association" is meant that the spectram sensitivity of each of the light-sensitive silver halide emulsion layers and the colour of the partial colour image produced from the spatially associated colour coupler have a certain relationship to one another, each of the spectral sensitivities (red, green, blue) being associated with a different colour of the particular partial colour image (generally, for example, the colours cyan, magenta and yellow, in this order).

Each of the silver halide emulsion layers sensitized to different spectral regions may have one or more colour couplers associated therewith. If several silver halide emulsion layers of the same spectral sensitivity are present, then each of these layers may contain a colour coupler and these colour couplers need not necessarily be identical, provided only that they give rise to at least approximately the same colour on colour development, normally a colour which is complementary to the colour of the light which is in the predominant range of sensitivity of the particular silver halide emulsion layers.

In preferred embodiments, red-sensitive silver halide emulsion layers should therefore be associated with at least one non-diffusible colour coupler for producing the cyan partial colour image, generally a coupler of the phenol or α-naphthol series; green-sensitive silver halide emulsion layers are in association with at least one non-diffusible colour coupler for producing the magenta partial colour image, these colour couplers optionally including monomeric (low molecular weight) magenta couplers of the 5-pyrazolone, indazolone or pyrazolo-azole series in addition to the polymeric magenta couplers according to the present invention. Blue-sensitive silver halide emulsion layers have at least one non-diffusible colour coupler associated with them for producing the yellow partial colour image, generally a colour coupler containing an open chain ketomethylene group. Numerous colour couplers of this kind are known and have been described in many Patent Specifications. Reference may be made, for example, to the publication by W. PELZ entitled "Farbkuppler" in "Mitteilungen aus den Forschungslaboratorien der Agfa, Leverkusen/München", Volume III, page 111 (1961) and by K. VENKATARAMAN in "The Chemistry of Synthetic Dyes", Volume 4, 341 to 387, Academic Press (1971).

Both the colour couplers according to this invention and the other colour couplers present in the colour photographic recording material may be either conventional 4-equivalent couplers or 2-equivalent couplers which require less silver halide for producing the colour. 2-Equivalent couplers are derived, as is known, from 4-equivalent couplers in that they carry in the coupling position a substituent which is split off in the coupling reaction. 2-Equivalent couplers include both couplers which are virtually colourless and those which have an intense intrinsic colour which disappears in the process of colour coupling to be replaced by the colour of the image dye produced. The latter couplers may also be present in the light-sensitive silver halide emulsion layers, where they act as masking couplers to compensate for the unwanted side densities of the image dyes. The 2-equivalent couplers also include the known white couplers which do not yield a dye in their reaction with colour developer oxidation products; further, they include couplers containing a group in the coupling position which is released in the reaction with colour developer oxidation products to produce a particular photographic effect, e.g. they may act as development inhibitors or accelerators. Examples of such 2-equivalent couplers include the known DIR couplers as well as the DAR and FAR couplers. The removable group may also be a ballast group so that the reaction with colour developer oxidation products may give rise to coupling products such as dyes which are diffusible or at least have a certain, if restricted mobility.

By "restricted mobility" is meant a degree of mobility which causes the contours of the discrete colour patches produced in chromogenic development to run and merge into one another. This degree of mobility is to be distinguished from the usual, complete immobility in photographic layers which is desirable for colour couplers and the resulting dyes in conventional photographic recording materials and ensures a sharp image and it should also be distinguished from the complete mobility of dyes such as is required, for example, in dye diffusion processes. The last mentioned dyes in most cases have at least one group which renders them soluble in an alkaline medium. The degree of restricted mobility required according to this invention may be controlled by varying the substituents, for example in order to influence and control the solubility in the organic medium of the oil former or the affinity to the binder matrix.

The usual layer supports may be used for the recording materials according to the invention, e.g. supports of cellulose esters such as cellulose acetate and of polyesters. Paper supports are also suitable and these may be coated, e.g. with polyolefines, in particular with polyethylene or polypropylene; see the above-mentioned Research Disclosure 17643, Chapter XVII.

The usual hydrophilic film-forming agents are suitable as protective colloids or binders for the layers of the recording material, e.g. proteins, in particular gelatine. Casting auxiliaries and plasticizers may also be used; see the above mentioned Research Disclosure 17643, Chapters IX, XI and XII.

The layers of the photographic material may be hardened in the usual manner, for example with hardeners containing at least two reactive oxirane, aziridine or acryloyl groups, or they may be hardened by the process described in DE-A-2 218 009. Furthermore, the photographic layers or colour photographic multilayered materials may be hardened with hardeners of the diazine, triazine or 1,2-dihydroquinoline series or with hardeners of the vinyl sulphone type. Other suitable hardeners have been disclosed in DE-A-2 439 551, DE-A-2 225 230 and DE-A-2 217 672 and in Research Disclosure 17643, Chapter X.

Other suitable additives are mentioned in Research Disclosure 17643 and in "Product Licensing Index" of December 1971, pages 107–110.

Suitable colour developer substances for the material according to the invention are in particular those of the p-phenylenediamine series, e.g. 4-amino-N,N-diethylaniline hydrochloride, 4-amino-3-methyl-N-ethyl-N-β-(methanesulphonamido)-ethylaniline sulphate hydrate, 4-amino-3-methyl-N-ethyl-N-β-hydroxyethylaniline sulphate, 4-amino-N-ethyl-N-(2-methoxyethyl)-m-toluidine-di-p-toluenesulphonic acid and N-ethyl-N-β-hydroxyethyl-p-phenylenediamine. Other suitable coupler developers are described, for example, in J. Amer. Chem. Soc. 73, 3100 (1951) and in G. Haist, Modern Photographic Processing, 1979, John Wiley and Sons, New York, pages 545 et seq.

After colour development, the material is bleached and fixed in the usual manner. Bleaching and fixing may be carried out separately or together. The usual bleaching agents may be used, e.g. $Fe^{3+}$ salts and $Fe^{3+}$ complex salts such as ferricyanides, dichromates, water-soluble cobalt complexes, etc. Iron-III complexes of aminopolycarboxylic acids are particularly preferred, in particular e.g. ethylenediaminotetracetic acid, nitrilotriacetic acid, iminodiacetic acid, N-hydroxyethylethylenediaminotriacetic acid, alkyliminodicarboxylic acids and corresponding phosphonic acids. Persulphates are also suitable bleaching agents.

EXAMPLE 1

The polymer couplers according to the invention, 1, 2, 3, 4, 7, and the polymeric comparison couplers A and B were added to various samples of a silver halide emulsion which had been green-sensitized to correspond to the colour coupler introduced. The silver halide-gelatine emulsion used consisted of 75 g of silver iodobromide (iodide content 3 mol-%) and 72 g of gelatine, based on 1 kg of emulsion.

The emulsions prepared as described above were applied to a cellulose triacetate support covered with an adhesive layer and were then dried.

Photographic tests:

The individual samples were exposed by means of a sensitometer and then processed with the following colour developer.

| Colour developer | |
|---|---|
| Distilled water | 800 g |
| Disodium salt of hydroxyethane diphosphonic acid | 2 g |
| Disodium salt of ethylene diaminotetracetic acid | 2 g |
| Potassium carbonate | 34 g |
| Sodium bicarbonate | 1.55 g |
| Sodium disulphite | 0.28 g |
| Sodium sulphite | 3.46 g |
| Potassium bromide | 1.34 g |
| Hydroxylamine sulphate | 2.4 g |
| N—ethyl-N—(β-hydroxy)-ethyl-4-amino-3-ethylaniline sulphate | 4.7 g |
| made up to 1000 ml with distilled water | |

| Processing | Processing [min] (25° C.) |
|---|---|
| Colour developer | 10 |
| Short stop bath | 4 |
| Intermediate washing | 5 |
| Bleaching bath | 5 |
| Intermediate washing | 5 |
| Fixing bath | 5 |
| Final washing | 10 |

The short stop, bleaching and fixing baths had the usual compositions. A formalin-free final bath was also used.

The absorption maximum $\lambda_{max}$ and the maximum colour density $D_{max}$ (Table 2) were determined.

TABLE 2

| Polymer coupler | $D_{max}$ | $\lambda_{max}$ |
|---|---|---|
| A (Comparison) | 0.62 | 545 |
| B (Comparison) | 0.54 | 546 |
| 1 | 2.90 | 548 |
| 2 | 3.10 | 550 |
| 3 | 2.74 | 550 |
| 4 | 2.83 | 548 |
| 7 | 2.62 | 550 |

The results show that good maximum densities are only obtained with the latex couplers according to the invention of the pyrazoloazole type. The comparison polymers without monomer S are unusable in practice owing to the low colour densities obtained.

EXAMPLE 2

The polymer couplers according to the invention, 22, 30 and 32, and the polymer comparison couplers C and D were tested photographically as described in Example 1.

The maximum colour densities $D_{max}$ and absorption maxima $\lambda_{max}$ found are shown in Table 3 below.

TABLE 3

| Polymer coupler | $D_{max}$ | $\lambda_{max}$ |
|---|---|---|
| 22 | 2.64 | 550 |
| 30 | 2.82 | 548 |
| 33 | 2.70 | 550 |
| C | 1.12 | 548 |
| D | 1.48 | 548 |

The results show that high colour densities can only be obtained with the latex couplers according to the invention of the pyrazoloazole type which contain a water-insoluble monomer S while polymers C and D which have been prepared under comparable conditions have insufficient colour density for practical use.

We claim:

1. Color photographic recording material containing at least one green-sensitized silver halide emulsion layer having associated therewith a polymeric color coupler said polymeric color coupler containing recurrent units of a polymerized monomer K and recurrent units of a polymerized monomer S, wherein said monomer K corresponds to the following formula IV

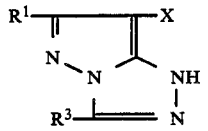

wherein $R^1$ denotes H, alkyl, aralkyl or aryl;

X denotes H or a group which can be split off by coupling and $R^3$ denotes alkyl, aralkyl, aryl, a heterocyclic group, alkoxy, a carbonamide group, OH or COOH, and at least one of $R^1$, X and $R^3$ contains an ethylenically unsaturated, polymerisable group, and wherein said monomer S contains at least one acid group selected from a carboxylic group and a phenolic group and is insoluble in water at pH $\leqq 6$ and soluble in water at pH $\geqq 10$.

2. Color photographic material as claimed in claim 1 wherein the polymeric color coupler compromises recurrent units of the following polymerised monomers:

20–70% by weight of monomer K,

5–50% by weight of monomer S and

0–75% by weight of another monomer C which is different from monomer K and from monomer S.

3. Color photographic material as claimed in claim 1 wherein the polymeric colour coupler comprises recurrent units of the following polymerised monomers:

25–50% by weight of monomer K,

10–30% by weight of monomer S and

20–65% by weight of monomer C.

* * * * *